US009724759B2

(12) United States Patent
Kitakizaki et al.

(10) Patent No.: US 9,724,759 B2
(45) Date of Patent: Aug. 8, 2017

(54) ELECTRODE MATERIAL

(71) Applicant: MEIDENSHA CORPORATION, Tokyo (JP)

(72) Inventors: Kaoru Kitakizaki, Saitama (JP); Keita Ishikawa, Tokyo (JP); Shota Hayashi, Tokyo (JP); Nobutaka Suzuki, Kodaira (JP); Kosuke Hasegawa, Numazu (JP)

(73) Assignee: MEIDENSHA CORPORATION, Tokyo (JP)

( * ) Notice: Subject to any disclaimer, the term of this patent is extended or adjusted under 35 U.S.C. 154(b) by 0 days.

(21) Appl. No.: 15/122,743

(22) PCT Filed: Feb. 17, 2015

(86) PCT No.: PCT/JP2015/054257

§ 371 (c)(1),
(2) Date: Aug. 31, 2016

(87) PCT Pub. No.: WO2015/133262

PCT Pub. Date: Sep. 11, 2015

(65) Prior Publication Data

US 2017/0066055 A1 Mar. 9, 2017

(30) Foreign Application Priority Data

Mar. 4, 2014 (JP) ..... 2014-041157

(51) Int. Cl.

| | |
|---|---|
| ***H01H 33/664*** | (2006.01) |
| ***B22F 3/16*** | (2006.01) |
| ***B22F 1/00*** | (2006.01) |
| ***B22F 3/26*** | (2006.01) |
| ***C22C 27/04*** | (2006.01) |
| ***H01H 1/025*** | (2006.01) |

(52) U.S. Cl.

CPC ..... *B22F 3/16* (2013.01); *B22F 1/0007* (2013.01); *B22F 3/26* (2013.01); *C22C 27/04* (2013.01); *H01H 1/025* (2013.01); *H01H 33/664* (2013.01); *B22F 2301/10* (2013.01); *B22F 2301/20* (2013.01); *B22F 2304/10* (2013.01); *B22F 2998/10* (2013.01)

(58) Field of Classification Search

CPC ..... C22C 9/00; C22C 9/10; B22F 3/00; B22F 3/26; H01H 33/664; H01H 1/025

See application file for complete search history.

(56) References Cited

U.S. PATENT DOCUMENTS

| | | | | |
|---|---|---|---|---|
| 4,486,631 | A * | 12/1984 | Naya | H01H 1/0206 200/266 |
| 4,836,978 | A | 6/1989 | Watanabe et al. | |
| 6,350,294 | B1 * | 2/2002 | Renner | C22C 1/0491 200/265 |
| 6,551,374 | B2 | 4/2003 | Doh et al. | |
| 2002/0068004 | A1 | 6/2002 | Doh et al. | |

FOREIGN PATENT DOCUMENTS

| | | | |
|---|---|---|---|
| JP | 59-119625 | A | 7/1984 |
| JP | 63-62122 | A | 3/1988 |
| JP | 4-334832 | A | 11/1992 |
| JP | 11-232971 | A | 8/1999 |
| JP | 2002-180150 | A | 6/2002 |
| JP | 2004-211173 | A | 7/2004 |
| JP | 2012-7203 | A | 1/2012 |

OTHER PUBLICATIONS

Werner F. Rieder et al., The Influence of Composition and Cr Particle Size of Cu/Cr Contacts on Chopping Current, Contact Resistance, and Breakdown Voltage in Vacuum Interrupters, IEEE Transactions on Components, Hybrids, and Manufacturing Technology, vol. 12, 1989, 273-283.

* cited by examiner

*Primary Examiner* — Jessee Roe
*Assistant Examiner* — Christopher Kessler
(74) *Attorney, Agent, or Firm* — Foley & Lardner LLP

(57) ABSTRACT

A method for producing an electrode material, involving: (i) a step of preparing a powder of a solid solution of Cr and a heat resistant material selected from the group consisting of Mo, W, Ta, Nb, V and Zr, wherein either a peak corresponding to Cr element or a peak corresponding to the heat resistant element, which are observed by X ray diffraction measurement made on the powder of the solid solution, disappears; (ii) a step of molding the powder of the solid solution to obtain a molded body and then sintering the molded body to produce a sintered body; and (iii) a Cu infiltration step of infiltrating the sintered body with Cu.

3 Claims, 6 Drawing Sheets

(a)

Mo:Cr=7:1 MIXED POWDER (b)

Mo:Cr=7:1 1250°C-3H SINTERING (a)

×400

(b)

×800

(a)

×1000

(b)

×2000

Mo:Cr=7:1 1200°C-0.5H SINTERING

Mo:Cr=7:1 1200°C-3H SINTERING

ELECTRODE MATERIAL

TECHNICAL FIELD

The present invention relates to a technique for controlling the composition of an electrode material.

BACKGROUND OF THE INVENTION

An electrode material used for an electrode of a vacuum interrupter (VI) etc. is required to fulfill the properties of: (1) a great current-interrupting capacity; (2) a high withstand voltage capability; (3) a low contact resistance; (4) a good welding resistance; (5) a lower consumption of contact point; (6) a small interrupting current; (7) an excellent workability; (8) a great mechanical strength; and the like.

A copper (Cu)-chromium (Cr) electrode has the properties of a good current-interrupting capacity, a high withstand voltage capability, a good welding resistance and the like and widely known as a material for a contact point of a vacuum interrupter. The Cu—Cr electrode has been reported that Cr particles having a finer particle diameter are more advantageous in terms of the current-interrupting capacity and the contact resistance (for example, by Non-Patent Document 1).

As a method for producing a Cu—Cr electrode material, two methods, a solid phase sintering method and a infiltration method are generally well known. In the solid phase sintering method, Cu having a good conductivity and Cr having an excellent arc resistance are mixed at a certain ratio, and the mixed powder is press molded and then sintered in a non-oxidizing atmosphere (for example, in a vacuum atmosphere) thereby producing a sintered body. The sintering method has the advantage that the composition between Cu and Cr can freely be selected, but it is higher in gas content than the infiltration method and therefore has a fear of being inferior to the infiltration method in mechanical strength.

On the other hand, in the infiltration method, a Cr powder is press molded (or not molded) and charged into a container and then heated to temperatures of not lower than the melting point of Cu in a non-oxidizing atmosphere (for example, in a vacuum atmosphere) to infiltrate Cu into airspaces defined among Cr particles, thereby producing an electrode. Although the composition ratio between Cu and Cr cannot freely be selected, the infiltration method has the advantage that a material smaller than the solid phase sintering method in gas content and the number of airspaces is obtained, the material being superior to the solid phase sintering method in mechanical strength.

In recent years, conditions for the use of the vacuum interrupter are getting restricted while the application of the vacuum interrupter to a capacitor circuit is increasingly developed. In a capacitor circuit a voltage two or three times the usual one is applied between electrodes, so that it is assumed that the surface of a contact point receives significant damages by arc generated at current-interrupting time or current-starting time thereby causing the reignition of arc easily. For example, when closing electrodes under a state of applying voltage, an electric field between a movable electrode and a fixed electrode is so strengthened as to cause an electrical breakdown before the electrodes are closed. An arc is to be generated at this time, and the surfaces of the contact points of the electrodes cause melting by the heat of the arc. After the electrodes have been closed, the melted portions are reduced in temperature by thermal diffusion so as to be welded. When opening the electrodes, the welded portions are stripped from each other and therefore the surfaces of the contact points are to be damaged. Hence there has been desired an electrode material having better withstand voltage capability and current-interrupting capability than those of the conventional Cu—Cr electrode.

As a method for producing a Cu—Cr based electrode material excellent in electrical characteristics such as withstand voltage capability and current-interrupting capability, there is a method of producing an electrode where a Cr powder for improving the electrical characteristics and a heat resistant element powder (molybdenum (Mo), tungsten (W), niobium (Nb), tantalum (Ta), vanadium (V), zirconium (Zr) etc.) for refining the Cr powder are added to a Cu powder as a base material and then the mixed powder is charged into a mold and press molded and finally obtain a sintered body (Patent Documents 1 and 2, for example).

To be more specific, a heat resistant element is added to a Cu—Cr based electrode material originated from Cr having a particle diameter of 200-300 μm, thereby refining Cr through a microstructure technique. Namely, the method is such as to accelerate the alloying of Cr and the heat resistant element and to increase the deposition of fine Cr—X particles (where X is a heat resistant element) in the interior of the Cu base material structure. As a result, Cr particles having a particle diameter of 20-60 μm is uniformly dispersed in the Cu base material structure, in the form of including the heat resistant element in the interior thereof.

In order to improve an electrode material in electrical characteristic such as current-interrupting capability and withstand voltage capability, it is required that in the Cr base material a content of Cr and that of a heat resistant element are large and that Cr and particles where Cr and the heat resistant element are changed into a solid solution are miniaturized in particle diameter and then uniformly dispersed in the Cu base material.

However, the Cr based particles contained in the electrode material of Patent Document 1 has a particle diameter of 20-60 μm. In order to enhance the electrical characteristics such as current-interrupting capability and withstand voltage capability, these particles are required to be more downsized.

In general, when using a Cr powder having a small average particle diameter as a raw material, it is possible to disperse the refined Cr particles uniformly in the Cu base material. However, a Cr powder having a small average particle diameter is used as a raw material, the oxygen content in the raw material Cr powder is increased, so that the current-interrupting capability of the Cu—Cr based electrode may disadvantageously be reduced.

REFERENCES ABOUT PRIOR ART

Patent Documents

Patent Document 1: Japanese Patent Application Publication No. 2012-007203

Patent Document 2: Japanese Patent Application Publication No. 2002-180150

Patent Document 3: Japanese Patent Application Publication No. 2004-211173

Patent Document 4: Japanese Patent Application Publication No. S63-062122

Non-Patent Documents

Non-Patent Document 1: RIEDER, F. u.a., "The Influence of Composition and Cr Particle Size of Cu/Cr Contacts on Chopping Current, Contact Resistance, and Breakdown Voltage in Vacuum Interrupters", IEEE Transactions on Components, Hybrids, and Manufacturing Technology, Vol. 12, 1989, 273-283

SUMMARY OF THE INVENTION

An object of the present invention is to provide a technique contributing to the improvement of withstand voltage capability and current-interrupting capability of an electrode material.

An aspect of an electrode material according to the present invention which can attain the above-mentioned object resides in an electrode material obtainable by: molding a solid solution powder of Cr and a heat resistant element, the solid solution powder containing Cr and the heat resistant element, wherein the volume-based relative particle amount of particles having a particle diameter of 30 μm or less is 50% or more; sintering the molded solid solution powder to produce a sintered body; and then infiltrating the sintered body with Cu.

Additionally, another aspect of an electrode material according to the present invention which can attain the above-mentioned object resides in the above-mentioned electrode material wherein the solid solution powder has a ratio of Cr to the heat resistant element of 4 or less to 1 by weight.

Additionally, a further aspect of an electrode material according to the present invention which can attain the above-mentioned object resides in the above-mentioned electrode material wherein the solid solution powder is obtainable by: mixing a powder of Cr and a powder of the heat resistant element; heating them to produce a solid solution; and then pulverizing the solid solution.

Additionally, a still further aspect of an electrode material according to the present invention which can attain the above-mentioned object resides in the above-mentioned electrode material wherein the powder of the heat resistant element has an average particle diameter of 2-20 μm.

Additionally, a still further aspect of an electrode material according to the present invention which can attain the above-mentioned object resides in the above-mentioned electrode material wherein the powder of Cr has a particle diameter of smaller than 300 μm.

Additionally, a still further aspect of an electrode material according to the present invention which can attain the above-mentioned object resides in the above-mentioned electrode material wherein the heat resistant element is at least one kind selected from Mo, W, Ta, Nb, V, Zr, Be, Hf, Ir, Pt, Ti, Si, Rh and Ru.

Additionally, a still further aspect of an electrode material according to the present invention which can attain the above-mentioned object resides in the above-mentioned electrode material wherein, in the solid solution powder, either a peak corresponding to Cr element or a peak corresponding to the heat resistant element, which are observed by X ray diffraction measurement made on the solid solution powder, completely disappears.

MODE(S) FOR CARRYING OUT THE INVENTION

Figure 1:
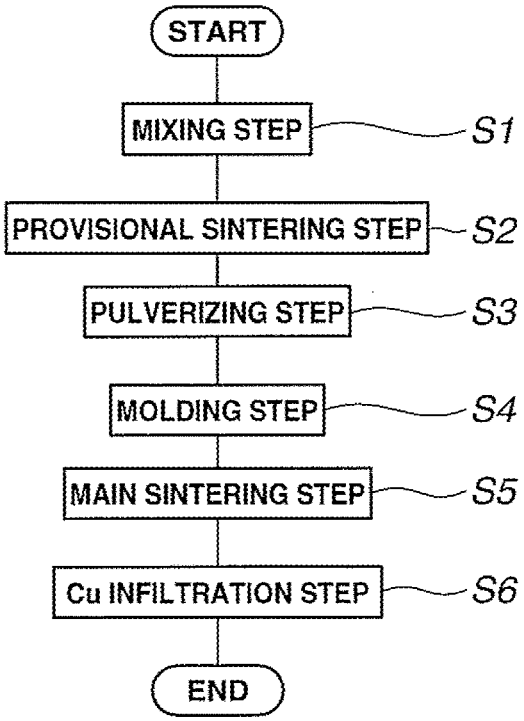
FIG. 1 A flow chart showing a method for producing an electrode material according to an embodiment of the present invention.

Referring now to the accompanying drawings, an electrode material according to an embodiment of the present invention will be discussed in detail. In the explanations on the embodiment, an average particle diameter (a median diameter d50) and a volume-based relative particle amount mean values measured by a laser diffraction particle size analyzer (available from CILAS under the trade name of CILAS 1090L) unless otherwise specified.

First of all, the inventors made studies on a relationship between the occurrence of restrike and the distributions of Cu and a heat resistant element (such as Mo and Cr), in advance of the present invention. As a result, a large number of minute embossments (for example, minute embossments of several ten micrometers to several hundred micrometers) were found at a region of Cu smaller than heat resistant elements in melting point by observing the surface of an electrode that had met with, restrike. These embossments generate an intense electric field at their top parts, and hence sometimes result in a factor for reducing a current-interrupting capability and a withstand voltage capability. The formation of the embossments is presumed to establish in such a manner that electrodes are melted and welded by a fed electric current and the welded portions are stripped from each other by a subsequent current-interrupting time. As a result of performing studies on the current-interrupting capability and the withstand voltage capability of the electrode material on the above-mentioned presumption, the present inventors have achieved a finding that the formation of minute embossments in the Cu region is suppressed while the probability of occurrence of restrike is lowered by reducing the particle size of the heat resistant element contained in the electrode and finely dispersing it and by finely uniformly dispersing the Cu region in the electrode surface. Additionally, an electrode contact point is supposed to cause a dielectric breakdown by its repeated opening/closing actions where particles of the heat resistant element on the electrode surface is pulverized and then the thus produced fine particles separate from the electrode surface; as a result of performing studies on an electrode material having a good withstand voltage capability in view of the above, the present inventors have achieved a finding that an effect of inhibiting the particles of the heat resistant element from being pulverized can be obtained when reducing the particle size of the heat resistant element contained in the electrode and finely dispersing it and when finely uniformly dispersing the Cu region in the electrode surface. As a result of having eagerly made studies on the particle diameter of the heat resistant element, the dispersibility of Cu, the withstand voltage capability of an electrode of a vacuum interrupter and the like in view of the findings as above, the present inventors achieved the completion of the present invention.

The present invention relates to a technique for controlling the composition of a Cu—Cr-heat resistant element (such as Mo, W and V) electrode material. In this invention, an electrode material for use in a vacuum interrupter can be improved in withstand voltage capability and current-interrupting capability, for example, by refining and uniformly dispersing Cr-containing particles while refining and uniformly dispersing a Cu structure (a highly conductive component) also and by providing a large content of a heat resistant element.

As a heat resistant element, an element selected from elements including molybdenum (Mo), tungsten (W), tantalum (Ta), niobium (Nb), vanadium (V), zirconium (Zr), beryllium (Be), hafnium (Hf), iridium (Ir), platinum (Pt), titanium (Ti), silicon (Si), rhodium (Rh) and ruthenium (Ru) can be used singly or in combination. Particularly, it is preferable to use Mo, W, Ta, Nb, V and Zr which are prominent in effect of refining Cr particles. In the case of using a heat resistant element in the form of powder, the heat resistant element powder is provided with an average particle diameter of 2-20 μm, more preferably 2-10 μm, thereby allowing fining the Cr-containing particles (i.e., particles containing a solid solution of a heat resistant element and Cr) and uniformly dispersing them in an electrode material. If the heat resistant element has a content of 6-76 wt %, more preferably 32-68 wt % relative to the electrode material, it is possible to improve the electrode material in withstand voltage capability and current-interrupting capability without impairing its mechanical strength and machinability.

When Cr has a content of 1.5-64 wt %, more preferably 4-15 wt % relative to the electrode material, it is possible to improve the electrode material in withstand voltage capability and current-interrupting capability without impairing its mechanical strength and machinability. In the case of using Cr particles, the Cr particles are provided with a particle diameter of, for example, −48 mesh (a particle diameter of less than 300 μm), more preferably −100 mesh (a particle diameter of less than 150 μm), much more preferably −325 mesh (a particle diameter of less than 45 μm), with which it is possible to obtain an electrode material excellent in withstand voltage capability and current-interrupting capability. Cr particles having a particle diameter of −100 mesh is able to reduce the amount of a remanent Cr which can be a factor for increasing the particle diameter of Cu having been infiltrated into the electrode material. Additionally, though it is preferable to use Cr particles having a small particle diameter from the viewpoint of dispersing fined-Cr-containing particles in the electrode material, finer Cr particles are to increase the oxygen content in the electrode material more and more thereby reducing the current-interrupting capability. The increase of the oxygen content in the electrode material, brought about by decreasing the particle diameter of the Cr particles, is assumed to be caused by Cr being finely pulverized and oxidized. Hence if only it is possible to process Cr into a fine powder under a condition where Cr does not oxidize (e.g. in an inert gas), Cr particles the particle diameter of which is less than −325 mesh may be employed. It is preferable to use Cr particles having a small particle diameter from the viewpoint of dispersing fined-Cr-containing particles in the electrode material.

When Cu has a content of 20-70 wt %, more preferably 25-60 wt % relative to the electrode material, it is possible to reduce the contact resistance of the electrode material without impairing its withstand voltage capability and current-interrupting capability. Incidentally, a Cu content of the electrode material is to be determined according to an infiltration step, so that the total of the heat resistant element, Cr and Cu, which are added to the electrode material, never exceeds 100 wt %.

Referring now to a flow chart shown in FIG. 1, a method for producing an electrode material according to an embodiment of the present invention will be discussed in detail. Explanations of this embodiment will be made by taking Mo as an example, and the same goes for the cases using other heat resistant elements.

In a mixing step S1, a Cr powder and a heat resistant element powder (for example, a Mo powder) are mixed. Though the average particle diameter of the Mo powder and the particle diameter of the Cr powder are not particularly limited, it is preferable that the average particle diameter of the Mo powder is 2 to 20 μm while the particle diameter of the Cr powder is −100 mesh. With this, it is possible to provide an electrode material where a Mo—Cr solid solution is uniformly dispersed in a Cu phase. Furthermore, the Mo powder and the Cr powder are mixed such that the weight ratio of Cr to Mo is four or less to one, more preferably ⅓ or less to one, thereby making it possible to produce an electrode material having good withstand voltage capability and current-interrupting capability.

In a provisional sintering step S2, a container reactive with neither Mo nor Cr (for example, an alumina container) is charged with the mixed powder obtained from the Mo powder and the Cr powder through the mixing step S1 (hereinafter referred to as "a mixed powder"), and then subjected to a provisional sintering in a non-oxidizing atmosphere (such as a hydrogen atmosphere and a vacuum atmosphere) at a certain temperature (for example, a temperature of 1250 to 1500° C.). By performing the provisional sintering, a Mo—Cr solid solution where Mo and Cr are dissolved and diffused into each other can be obtained. In the provisional sintering step S2, it is not always necessary to conduct provisional sintering until. Mo and Cr fully form a solid solution; however, if a provisional sintered body where either one or both of a peak corresponding to Mo element and a peak corresponding to Cr element (which peaks are observed by X ray diffraction measurement) completely disappear (in other words, a provisional sintered body where either one of Mo and Cr is completely dissolved in the other one) is used, it is possible to obtain an electrode material having a better withstand voltage capability. Accordingly, in a case of the Mo powder being mixed in a larger amount, for example, the sintering temperature and the sintering time in the provisional sintering step S2 are so selected that at least the peak corresponding to Cr element disappears at the time of X ray diffraction measurement made on the Mo—Cr solid solution. In the other case where the Cr powder is mixed in a larger amount, the sintering temperature and the sintering time in the provisional sintering step S2 are so selected that at least the peak corresponding to Mo element disappears at the time of X ray diffraction measurement made on the Mo—Cr solid solution.

Additionally, in the provisional sintering step S2, press molding (or press treatment) may be conducted on the mixed powder before provisional sintering. By conducting press molding, the mutual diffusion of Mo and Cr is accelerated and therefore the provisional sintering time may be shortened while the provisional sintering temperature may be lowered. Pressure applied in press molding is not particularly limited but it is preferably not higher than 0.1 t/cm$^2$. If a significantly high pressure is applied in press molding the mixed powder, the provisional sintered body is to get hardened so that the pulverizing operation in the subsequent pulverizing step S3 may have difficulty.

In a pulverizing step S3, the Mo—Cr solid solution is pulverized by using a pulverizer (for example, a planetary ball mill), thereby obtaining a powder of the Mo—Cr solid solution (hereinafter referred to as "a Mo—Cr powder"). An atmosphere applied in pulverization in the pulverizing step S3 is preferably a non-oxidizing atmosphere, but a pulverization in the air may also be acceptable. A pulverizing condition is required only to be such an extent as to be able to pulverize particles (secondary particles) where Mo—Cr solid solution particles are bonded to each other. Incidentally, in pulverization of the Mo—Cr solid solution, a longer pulverization time makes the average particle diameter of the Mo—Cr solid solution particles smaller. Hence, the case of the Mo—Cr powder is provided with a pulverizing condition where the volume-based relative particle amount of particles having a particle diameter of 30 μm or less (more preferably, particles having a particle diameter of 20 μm or less) is not lower than 50%, thereby obtaining an electrode material in which Mo—Cr particles (where Mo and Cr are dissolved and diffused into each other) and a Cu structure are uniformly dispersed (in other words, an electrode material excellent in withstand voltage capability.

In a molding step S4, molding of the Mo—Cr powder is conducted. Molding of the Mo—Cr powder is performed by press molding the Mo—Cr powder at a pressure of 2 t/cm$^2$, for example.

In a main sintering step S5, the molded Mo—Cr powder is subjected to main sintering, thereby obtaining a Mo—Cr sintered body (or a Mo—Cr skeleton). Main sintering is performed by sintering the molded body of the Mo—Cr powder at 1150° C. for 2 hours in vacuum atmosphere, for example. The main sintering step S5 is a step of producing a denser Mo—Cr sintered body by deforming and bonding the Mo—Cr powder. Sintering of the Mo—Cr powder is preferably carried out under a temperature condition of the subsequent infiltration step S6, for example, at a temperature of 1150° C. or higher. This is because, if sintering is performed at a temperature lower than an infiltration temperature, gas contained in the Mo—Cr sintered body comes to up newly at the time of Cu infiltration and remains in a Cu-infiltrated body thereby possibly behaving as a factor for impairing the withstand voltage capability and current-interrupting capability. The sintering temperature employed in the present invention is a temperature higher than the Cu infiltration temperature and not higher than the melting point of Cr, preferably a temperature ranging from 1150° C. to 1500° C. Within the above-mentioned range, densification of the Mo—Cr particles is accelerated and degasification of the Mo—Cr particles is sufficiently developed.

In a Cu infiltration step S6, the Mo—Cr sintered body is infiltrated with Cu. Infiltration with Cu is performed by disposing a Cu plate material onto the Mo—Cr sintered body and keeping it in a non-oxidizing atmosphere at a temperature of not lower than the melting point of Cu for a certain period of time (e.g. at 1150° C. for two hours), for example.

Figure 2:
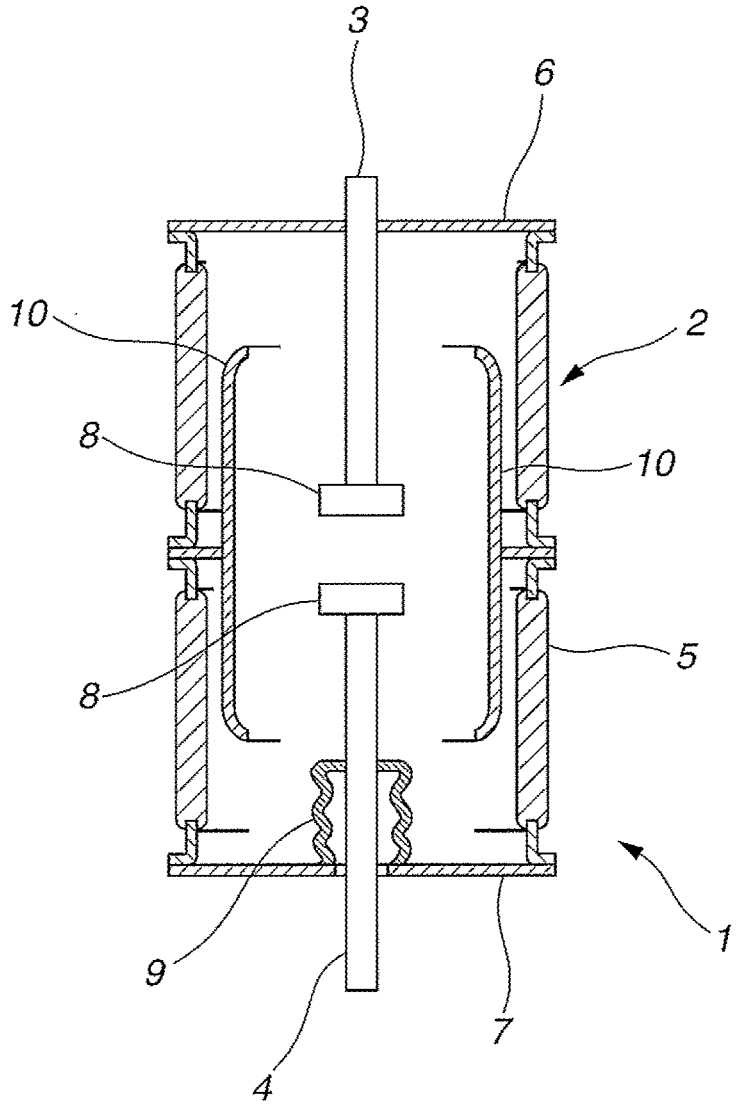
FIG. 2 A schematic cross-sectional view of a vacuum interrupter provided with an electrode material according to an embodiment of the present invention.

Incidentally, it is possible to construct a vacuum interrupter by using an electrode material according to an embodiment of the present invention. As shown in FIG. 2, a vacuum interrupter 1 comprising an electrode material according to an embodiment of the present invention is provided to include a vacuum vessel 2, a fixed electrode 3, a movable electrode 4 and a main shield 10.

The vacuum vessel 2 is configured such that an insulating cylinder 5 is sealed at its both opening ends with a fixed-side end plate 6 and a movable-side end plate 7, respectively.

The fixed electrode 3 is fixed in a state of penetrating the fixed-side end plate 6. The fixed electrode 3 is fixed in such a manner that its one end is opposed to one end of the movable electrode 4 in the vacuum vessel 2, and additionally, provided with an electrode contact material 8 (serving as an electrode material according to an embodiment of the present invention) at an end portion opposing to the movable electrode 4.

The movable electrode 4 is provided at the movable-side end plate 7. The movable electrode 4 is disposed coaxial with the fixed electrode 3. The movable electrode 4 is moved in the axial direction by a non-illustrated opening/closing means, with which an opening/closing action between the fixed electrode 3 and the movable electrode 4 is attained. The movable electrode 4 is provided with an electrode contact material 8 at an end portion opposing to the fixed electrode 3. Between the movable electrode 4 and the movable-side end plate 7 a bellows 9 is disposed, so that the movable electrode 4 can vertically be moved to attain the opening/closing action between the fixed electrode 3 and the movable electrode 4 while keeping the vacuum state of the vacuum vessel 2.

The main shield 10 is mounted to cover a contact part of the electrode contact material 8 of the fixed electrode 3 and the electrode contact material 8 of the movable electrode 4, so as to protect the insulating cylinder 5 from an arc generated between the fixed electrode 3 and the movable electrode 4.

Example 1

Referring now to a concrete example, an electrode material according to an embodiment of the present invention will be discussed in detail. An electrode material of Example 1 was produced according to the flow chart of FIG. 1.

A Mo powder and a Cr powder were sufficiently uniformly mixed at a weight ratio of Mo:Cr=7:1 by using a V type blender.

As the Mo powder, a powder having a particle diameter of 2.8 to 3.7 μm was employed. As a result of measuring the particle diameter distribution of this Mo powder by using a laser diffraction particle size analyzer, it was confirmed to have a median diameter d50 of 5.1 μm (and a d10 of 3.1 μm and a d90 of 8.8 μm). The Cr powder was a powder of −325 mesh (mesh opening of 45 μm).

After the mixing operation was completed, the mixed powder of the Mo powder and the Cr powder was moved into an alumina container, followed by conducting a provisional sintering in a vacuum furnace. Incidentally, if the degree of vacuum after keeping the powder at the provisional sintering temperature for a certain period of time is not larger than $5\times10^{-3}$ Pa, an electrode material produced from the thus obtained provisional sintered body is so reduced in oxygen content as not to impair the current-interrupting capability of the electrode material.

In the provisional sintering step, a provisional sintering was conducted on the mixed powder at 1250° C. for three hours. The vacuum furnace had a degree of vacuum of $3.5\times10^{-3}$ Pa after performing sintering at 1250° C. for three hours.

After cooling, the Mo—Cr provisional sintered body was taken out of the vacuum furnace and then pulverized by using a planetary ball mill for ten minutes, thereby obtaining a Mo—Cr powder. After pulverization, the Mo—Cr powder was subjected to X ray diffraction (XRD) measurement to determine the crystal constant of the Mo—Cr powder. The lattice constant a of the Mo—Cr powder (Mo:Cr=7:1) was 0.3107 nm. Incidentally, the lattice constant a of the Mo powder (Mo) was 0.3151 nm while the lattice constant a of the Cr powder (Cr) was 0.2890 nm.

As a result of the X ray diffraction (XRD) measurement made on the Mo—Cr powder (Mo:Cr=7:1), peaks corresponding to 0.3151 nm and 0.2890 nm were confirmed to have disappeared. It is known from this that Mo element and Cr element are dispersed in each other in solid phase by performing the provisional sintering thereby changing Mo and Cr into a solid solution.

Figure 3:
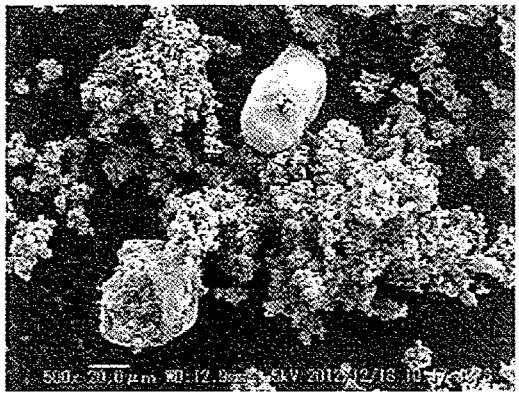
FIG. 3 (*a*) An electron micrograph of a mixed powder of a Cr powder and a Mo powder. (*b*) An electron micrograph of a Mo—Cr powder.
Figure 3:
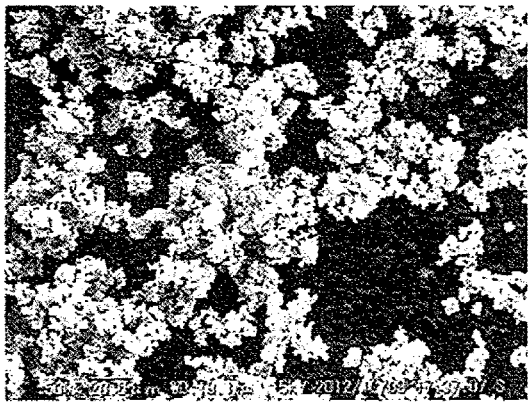

FIG. 3(*a*) is an electron micrograph of the mixed powder of the Mo powder and the Cr powder. Relatively large particles as shown in the lower left part and in the upper-middle part, having a particle diameter of about 45 μm, are Cr powder. Meanwhile, fine flocculated particles are Mo powder.

FIG. 3(*b*) is an electron micrograph of the Mo—Cr powder. Relatively large particles having a particle diameter of about 45 μm are not observed. It was confirmed that Cr did not exist in a state of a raw material in terms of size. Moreover, the average particle diameter (the median diameter d50) of the Mo—Cr powder was 15.1 μm.

From the result of the X ray diffraction (XRD) measurement and from the electron micrographs, it is assumed that Cr is fined by sintering at 1250° C. for three hours after mixing Mo an Cr and that then Mo and Cr are diffused into each other thereby forming a solid solution of Mo and Cr.

Thereafter, the Mo—Cr powder obtained after the pulverizing step was press molded under a pressure of 2 t/cm$^2$ in use of a press machine to obtain a molded body. This molded body was subjected to main sintering at 1150° C. for two hours in vacuum atmosphere, thereby producing a Mo—Cr sintered body.

Subsequently, a Cu plate material was disposed onto the Mo—Cr sintered body and kept at 1150° C. for two hours in a vacuum furnace so as to infiltrate Cu into the Mo—Cr sintered body, thereby obtaining an electrode material (a Cu—Cr—Mo electrode) of Example 1.

[Cross-Sectional Observation of Electrode Material]

A cross section of the electrode material of Example 1 was observed by an electron microscope. Photomicrographs of the cross section of the electrode material are shown in FIG. 4(*a*) and FIG. 4(*b*).

Figure 4:
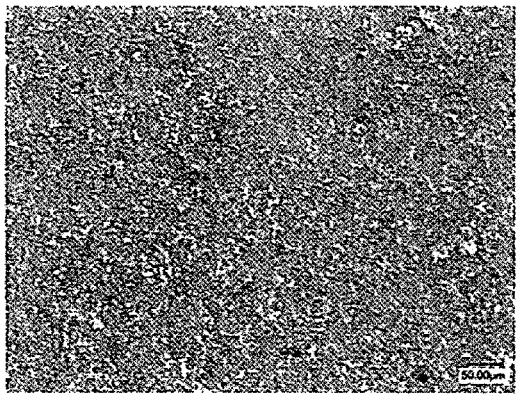
FIG. 4 A photomicrograph of a cross section of an electrode material of Example 1 (400 magnifications), and a photomicrograph of a cross section of an electrode material of Example 1 (800 magnifications).
Figure 4:
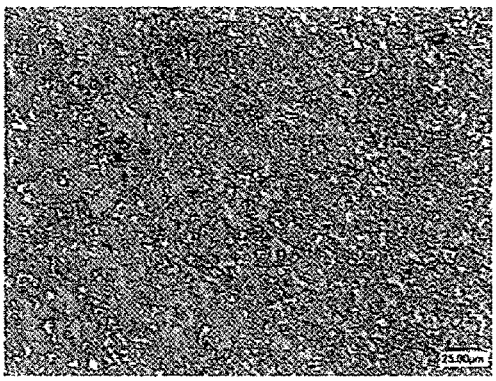

In FIGS. 4(*a*) and 4(*b*), a region which looks relatively whitish (a white region) is an alloy structure where Mo and Cr have been changed into a solid solution while a region which looks relatively dark (a gray region) is a Cu structure. In the electrode material of Example 1, fine alloy structures of 1 to 10 μm (whitish regions) were uniformly fined and dispersed. Additionally, Cu structures were also uniformly dispersed without any uneven distribution.

[Average Particle Diameter of Mo—Cr Powder in Electrode Material]

The cross-sectional structure of the electrode material of Example 1 was observed by using SEM (a scanning electron microscope). SEM images of the electrode material are shown in FIG. 5(*a*) and FIG. 5(*b*).

Figure 5:
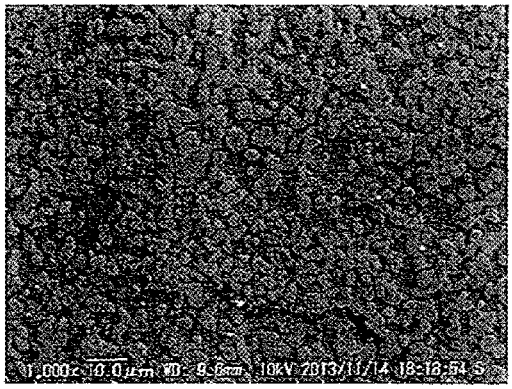
FIG. 5 (*a*) An SEM (scanning electron microscope) image of a cross-sectional structure of the electrode material of Example 1 (1000 magnifications). (*b*) An SEM image of the cross-sectional structure of the electrode material of Example 1 (2000 magnifications).
Figure 5:
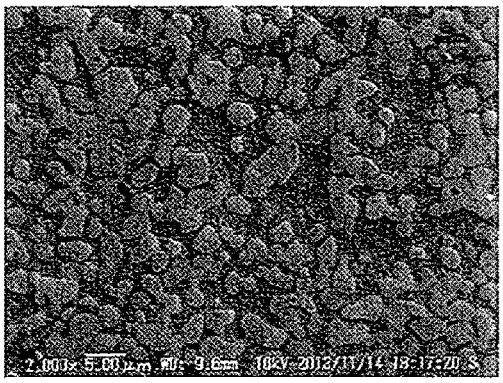

From the SEM images as shown in FIG. 5(*a*) and FIG. 5(*b*), the average particle diameter of the alloy structure (the white region) where Mo and Cr have been changed into a solid solution was calculated. The average particle diameter dm of the Mo—Cr powder in the electrode material was determined from the Fullman's equations disclosed by International Application Publication No. WO2012153858.

$$dm=(4/\pi)\times(N_L/N_S) \quad (1)$$

$$N_L=n_L/L \quad (2)$$

$$N_S=n_S/S \quad (3)$$

where dm: Average particle diameter,

π: The ratio of the circumference of a circle to its diameter, $N_L$: The number of particles per unit length, which are hit by an arbitrary straight line drawn on the cross-sectional structure, $N_S$: The number of particles per unit area, which are hit in an arbitrary measuring region, $n_L$: The number of particles hit by an arbitrary straight line drawn on the cross-sectional structure, L: The length of an arbitrary straight line drawn on the cross-sectional structure, $n_s$: The number of particles included in an arbitrary measuring region, and S: The area of an arbitrary measuring region.

To be more specific by using the SEM image as shown in FIG. 5(*a*), $n_s$ i.e. the number of the Mo—Cr particles included in the SEM image (the whole of the image is regarded as a measuring area S) was counted. Subsequently, an arbitrary straight line (having a length L) dividing the SEM image into equal parts was drawn and then $n_L$ i.e. the number of particles hit by the straight line was counted.

These values $n_L$ and $n_s$ were divided by L and S to determine $N_L$ and $N_S$, respectively. Furthermore, $N_L$ and $N_S$ were substituted into the equation (1) thereby obtaining the average particle diameter dm.

As a result of this, the Mo—Cr powder of the electrode material of Example 1 was confirmed to have an average particle diameter dm of 3.8 μm. It has already been discussed that a Mo—Cr powder obtained by conducing provisional sintering on the mixed powder at 1250° C. for three hours and then pulverized by a planetary ball mill had an average particle diameter of 15.7 μm. Since the Mo—Cr powder was confirmed to have an average particle diameter dm of 3.8 μm as a result of performing a cross-sectional observation after Cu infiltration and executing the Fullman's equations, the refinement of the Mo—Cr particles is supposed to have been further accelerated in the Cu infiltration step S6. In other words, the average particle diameter of the Mo—Cr particles, which was determined by performing a cross-sectional observation after Cu infiltration and executing the Fullman's equations, was prevented from rising more than 15 μm when such a pulverizing condition that d50 is 30 μm or smaller was given to the Mo—Cr powder obtained by the pulverizing step S3.

[State of Dispersion of Mo—Cr Particles in Electrode Material]

The characteristics of an electrode material depends on not only how many Mo—Cr particles exist in the electrode material and the approximate size of the Mo—Cr particles but also the extent to which the Mo—Cr particles are uniformly dispersed.

Therefore, an index of a state of dispersion of the Mo—Cr particles in the electrode material of Example 1 was calculated from the SEM images as shown in FIG. 5(*a*) and FIG. 5(*b*), thereby evaluating the state of microdispersion in the electrode structure. An index of the dispersion state was determined according to a method disclosed in Japanese Patent Application Publication No. H04-074924.

More specifically, a distance between the barycenters of the Mo—Cr particles was measured at one hundred different locations by using the SEM image of FIG. 5(*b*), and then an average value ave.X of all of the measured barycentric distances X and a standard deviation σ were calculated, and then the thus obtained ave.X and the value σ were substituted into the equation (4) to determine an index of the dispersion state CV.

$$CV=\sigma/\text{ave}.X \quad (4)$$

As a result, an average value ave.X of a distance between barycenters X was 5.25 μm, a standard deviation σ was 3.0 μm, and an index of the dispersion state CV was 0.57.

Example 2

In an electrode material of Example 2, a Mo powder and a Cr powder were mixed at a weight ratio of Mo:Cr=9:1. The electrode material of Example 2 was made from the same raw materials as those in Example 1 and produced by the same method as that of Example 1 with the exception that the mixing ratio between the Mo powder and the Cr powder was modified.

A Mo—Cr powder obtained by pulverizing a provisional sintered body of Example 2 was subjected to X ray diffraction (XRD) measurement to determine the lattice constant a of the Mo—Cr powder. The lattice constant a of the Mo—Cr powder (Mo:Cr=9:1) was 0.3118 nm and fitted the Vegard's Law. Since the lattice constant a fitted the Vegard's Law, Mo and Cr were deemed to diffuse into each other to form a disorder-type solid solution.

Example 3

In an electrode material of Example 3, a Mo powder and a Cr powder were mixed at a weight ratio of Mo:Cr=5:1. The electrode material of Example 3 was made from the same raw materials as those in Example 1 and produced by the same method as that of Example 1 with the exception that the mixing ratio between the Mo powder and the Cr powder was modified.

A Mo—Cr powder obtained by pulverizing a provisional sintered body of Example 3 was subjected to X ray diffraction (XRD) measurement to determine the lattice constant a of the Mo—Cr powder. The lattice constant a of the Mo—Cr powder (Mo:Cr=5:1) was 0.3094 nm and fitted the Vegard's Law.

Example 4

In an electrode material of Example 4, a Mo powder and a Cr powder were mixed at a weight ratio of Mo:Cr=3:1. The electrode material of Example 4 was made from the same raw materials as those in Example 1 and produced by the same method as that of Example 1 with the exception that the mixing ratio between the Mo powder and the Cr powder was modified.

A Mo—Cr powder obtained by pulverizing a provisional sintered body of Example 4 was subjected to X ray diffraction (XRD) measurement to determine the lattice constant a of the Mo—Cr powder. The lattice constant a of the Mo—Cr powder (Mo:Cr=3:1) was 0.3073 nm and fitted the Vegard's Law.

Example 5

In an electrode material of Example 5, a Mo powder and a Cr powder were mixed at a weight ratio of Mo:Cr=1:1. The electrode material of Example 5 was made from the same raw materials as those in Example 1 and produced by the same method as that of Example 1 with the exception that the mixing ratio between the Mo powder and the Cr powder was modified.

A Mo—Cr powder obtained by pulverizing a provisional sintered body of Example 5 was subjected to X ray diffraction (XRD) measurement to determine the lattice constant a of the Mo—Cr powder. The lattice constant a of the Mo—Cr powder (Mo:Cr=1:1) was 0.3013 nm and fitted the Vegard's Law.

Example 6

In an electrode material of Example 6, a Mo powder and a Cr powder were mixed at a weight ratio of Mo:Cr=1:3. The electrode material of Example 6 was made from the same raw materials as those in Example 1 and produced by the same method as that of Example 1 with the exception that the mixing ratio between the Mo powder and the Cr powder was modified.

A Mo—Cr powder obtained by pulverizing a provisional sintered body of Example 6 was subjected to X ray diffraction (XRD) measurement to determine the lattice constant a of the Mo—Cr powder. The lattice constant a of the Mo—Cr powder (Mo:Cr=1:3) was 0.2929 nm and fitted the Vegard's Law.

Example 7

In an electrode material of Example 7, a Mo powder and a Cr powder were mixed at a weight ratio of Mo:Cr=1:4. The electrode material of Example 7 was made from the same raw materials as those in Example 1 and produced by the same method as that of Example 1 with the exception that the mixing ratio between the Mo powder and the Cr powder was modified.

A Mo—Cr powder obtained by pulverizing a provisional sintered body of Example 7 was subjected to X ray diffraction (XRD) measurement to determine the lattice constant a of the Mo—Cr powder. The lattice constant a of the Mo—Cr powder (Mo:Cr=1:4) was 0.2924 nm and fitted the Vegard's Law.

A cross-sectional observation of an infiltrated body was conducted on each of the electrode materials of Examples 2 to 7. As a result, it was confirmed in all of the test samples that fine Mo—Cr alloy structures of 1 to 10 μm were uniformly refined while Cu structures were also uniformly dispersed without any uneven distribution.

Reference Example 1

An electrode material of Reference Example 1 underwent a provisional sintering at 1200° C. for 30 minutes in the provisional sintering step. The electrode material of Reference Example 1 was made from the same raw materials as those in Example 1 and produced by the same method as that of Example 1 with the exception that the time and the temperature in the provisional sintering step were modified.

A Mo powder and a Cr powder were sufficiently uniformly mixed at a weight ratio of Mo:Cr=7:1 by using a V type blender. After the mixing operation was completed, the mixed powder of the Mo powder and the Cr powder was moved into an alumina container, followed by conducting a provisional sintering in a vacuum furnace. In this provisional sintering step, a provisional sintering was conducted on the mixed powder at 1200° C. for 30 minutes. The degree of vacuum in the vacuum furnace after sintering the powder at 1200° C. for 30 minutes was $3.5\times10^{-3}$ Pa.

After cooling, a Mo—Cr provisional sintered body was taken out of the vacuum furnace and then pulverized by using a planetary ball mill, thereby obtaining a Mo—Cr powder. An X ray diffraction (XRD) measurement was conducted on the Mo—Cr powder in order to determine the crystal constant of the Mo—Cr powder. As a result of this, it was confirmed that a peak of 0.3131 nm and a peak of 0.2890 nm, which was the lattice constant a of Cr element, were coresident with each other.

Figure 6:
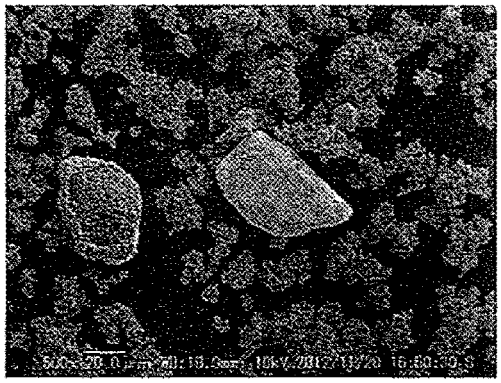
FIG. 6 An electron micrograph of a Mo—Cr powder used in Reference Example 1 (500 magnifications).

As a result of observing the Mo—Cr powder of Reference Example 1 by an electron microscope (500 magnifications), the Mo—Cr powder was confirmed to partially include Cr particles having a particle diameter of about 40 μm as shown in FIG. 6. More specifically; both the refinement of Cr and the diffusion of Cr into Mo particles were insufficient under the heat treatment condition that the temperature was 1200° C. and the time was 30 minutes.

Reference Example 2

An electrode material of Reference Example 2 underwent a provisional sintering at 1200° C. for three hours in the provisional sintering step. The electrode material of Reference Example 2 was made from the same raw materials as those in Example 1 and produced by the same method as that of Example 1 with the exception that the temperature in the provisional sintering step was modified.

A Mo powder and a Cr powder were sufficiently uniformly mixed at a weight ratio of Mo:Cr=7:1 by using a V type blender. After the mixing operation was completed, the mixed powder of the Mo powder and the Cr powder was moved into an alumina container, followed by conducting a provisional sintering in a vacuum furnace. In this provisional sintering step, a provisional sintering was conducted on the mixed powder at 1200° C. for three hours. The degree of vacuum in the vacuum furnace after sintering the powder at 1200° C. for three hours was $3.5\times10^{-3}$ Pa.

After cooling, a Mo—Cr provisional sintered body was taken out of the vacuum furnace and then pulverized by using a planetary ball mill, thereby obtaining a Mo—Cr powder. After pulverization, an X ray diffraction (XRD) measurement was conducted on the Mo—Cr powder in order to determine the crystal constant of the pulverized powder. As a result of this, it was confirmed that a peak of 0.3121 nm and a peak of 0.2890 nm, which was the lattice constant a of Cr element, were coresident with each other.

Figure 7:
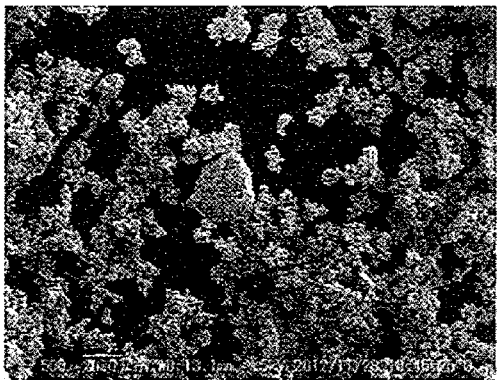
FIG. 7 An electron micrograph of a Mo—Cr powder used in Reference Example 2 (500 magnifications).

As a result of observing the Mo—Cr powder of Reference Example 2 by an electron microscope (500 magnifications), the Mo—Cr powder was confirmed to partially include Cr particles having a particle diameter of about 40 μm as shown in FIG. 7. More specifically, both the refinement of Cr and the diffusion of Cr into Mo particles were insufficient under the heat treatment condition that the temperature was 1200° C. and the time was three hours.

Though both the refinement of Cr and the diffusion of Cr into Mo particles were insufficient under the heat treatment condition of Reference Examples 1 and 2, it will be understood that if the provisional sintering is performed for a sufficiently long period of time Mo and Cr can be diffused into each other to form a solid solution of Mo and Cr even under the temperature condition. However, a longer period of provisional sintering time should increase the vacuum furnace-running cost more and more, which may become a factor for increasing the cost of manufacturing an electrode material.

Example 8

A Mo powder and a Cr powder were sufficiently uniformly mixed at a weight ratio of Mo:Cr=1:4 by using a V type blender.

As the Mo powder, a powder having a particle diameter of 4.0 μm or larger was employed. As a result of measuring the particle diameter distribution of this Mo powder by using a laser diffraction particle size analyzer, it was confirmed to have a median diameter d50 of 10.4 μm (and a d10 of 5.3 μm and a d90 of 19.0 μm). The Cr powder was a powder of −180 mesh (mesh opening of 80 μm).

After the mixing operation was completed, the mixed powder of the Mo powder and the Cr powder was moved into an alumina container, followed by being kept in a vacuum furnace at 1250° C. for three hours, thereby producing a provisional sintered body. The degree of vacuum after keeping at 1250° C. for three hours was finally $3.5\times10^{-3}$ Pa.

After cooling, the Mo—Cr provisional sintered body was taken out of the vacuum furnace and then pulverized by using a planetary ball mill, thereby obtaining a Mo—Cr powder. After pulverization, the Mo—Cr powder was subjected to X ray diffraction (XRD) measurement to determine the crystal constant of the Mo—Cr powder. The lattice constant a (Mo:Cr=1:4) was 0.2926 nm. A peak of 0.3151 nm (i.e. the lattice constant a of Mo element) was not observed while a peak of 0.2890 nm (i.e. the lattice constant a of Cr element) was hardly observed.

Thereafter, the Mo—Cr powder was press molded under a pressure of 2 t/cm$^2$ to obtain a molded body. This molded body was subjected to main sintering at 1150° C. for two hours in vacuum atmosphere, thereby producing a Mo—Cr sintered body. Subsequently, a Cu plate material was disposed onto the Mo—Cr sintered body and kept at 1150° C. for two hours in a vacuum furnace so as to infiltrate Cu into the Mo—Cr sintered body.

A cross-sectional observation was conducted on the electrode material of Example 8 by an electron microscope (800 magnifications). As a result, it was confirmed that fine Mo—Cr solid solution structures (white regions) of 3 to 20 μm were uniformly refined and dispersed. Additionally, Cu structures were also uniformly dispersed without any uneven distribution.

Comparative Example 1

Figure 8:
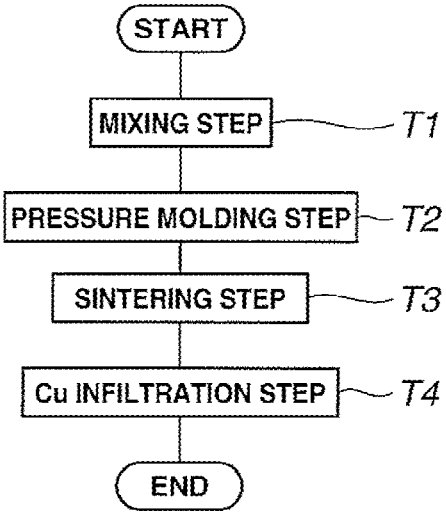
FIG. 8 A flow chart showing a method for producing an electrode material according to Comparative Example.

An electrode material of Comparative Example 1 was produced according to the flow chart of FIG. 8.

A Mo powder and a Cr powder were sufficiently uniformly mixed at a weight ratio of Mo:Cr=7:1 by using a V type blender (a mixing step T1).

As the Mo powder, a powder having a median diameter d50 of 5.1 μm (and a d10 of 3.1 μm and a d90 of 8.8 μm) was employed similar to Example 1. As the Cr powder, a powder of −180 mesh (mesh opening of 80 μm) was employed.

After the mixing operation was completed, the mixed powder of the Mo powder and the Cr powder was press molded under a pressure of 2 t/cm$^2$ to obtain a molded body (a press molding step T2). This molded body was kept at a temperature of 1200° C. for two hours in vacuum atmosphere to be subjected to main sintering (a sintering step T3), thereby producing a Mo—Cr sintered body.

Subsequently, a Cu plate material was disposed onto the Mo—Cr sintered body and kept at 1150° C. for two hours in a vacuum furnace so as to achieve a Cu infiltration (a Cu infiltration step T4). Thus Cu is sintered into the Mo—Cr sintered body, in the liquid phase, thereby obtaining a uniformly infiltrated body.

Figure 9:
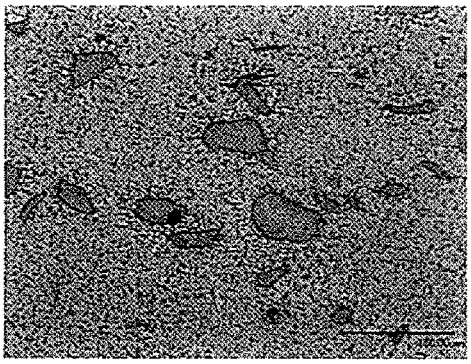
FIG. 9 A photomicrograph of a cross section of an electrode material of Comparative Example 1 (800 magnifications).

FIG. 9 is an electron micrograph of the electrode material of Comparative Example 1 (800 magnifications). In FIG. 9, a region which looks relatively whitish (a white region) is a structure where Mo and Cr have been changed into a solid solution while a region which looks relatively dark (a gray region) is a Cu structure.

The electrode material of Comparative Example 1 is confirmed to have a structure where Cu of 20-60 μm particle diameter (gray regions) were dispersed in fine Mo—Cr solid solution particles of 1 to 10 μm (whitish regions). This is assumed to be a result of Cu having infiltrated into airspaces in the Cu infiltration step T4, the airspaces having been formed through a step where Cr particles are refined by Mo particles and diffused into the Mo particles by its diffusion mechanism so as to form solid solution structures together with Mo.

Comparative Example 2

An electrode material of Comparative Example 2 was made from the same raw materials as those in Comparative Example 1 and produced by the same method as that of Comparative Example 1 with the exception that a Cr powder of −325 mesh (mesh opening of 45 μm) was employed.

As a result of conducting a cross-sectional observation on the electrode material of Comparative Example 2 by using an electron microscope (800 magnifications), a structure where Cu having a particle diameter of 15-40 μm was dispersed in 1-10 μm fine Mo—Cr solid solution particles was observed. This is assumed to be a result of Cu having infiltrated into airspaces in the Cu infiltration step T4, the airspaces having been formed through a step where Cr particles are refined by Mo particles and diffused into the Mo particles by its diffusion mechanism so as to form solid solution structures together with Mo.

It is found from the results of Comparative Examples 1 and 2 that, in a conventional technique where Mo and Cr are press molded after being mixed and then Cu is infiltrated thereinto, there exists a structure in which Cu having a particle diameter reflecting that of the Cr powder (used as a raw material) are unevenly dispersed. On the contrary, in an electrode material according to an embodiment of the present invention, particles where a heat resistant element (such as Mo, W, Nb, Ta, V and Zr) and Cr are dissolved and diffused into each other can be refined and uniformly dispersed while Cu portions (serving as a highly conductive component) can also be refined and uniformly dispersed. As a result, the electrode material can be improved in withstand voltage capability and current-interrupting capability.

TABLE 1

| | Mixing Ratio Mo:Cr | Particle Diameter of Mo (μm) | Particle Diameter of Cr | Sintering Condition | Disappearance of Peak | Pressure applied in Press Molding (t/cm$^2$) | Withstand Voltage (Relative Value) |
|---|---|---|---|---|---|---|---|
| Example 1 | 7:1 | 2.8-3.7 | −325 Mesh | 1250° C.-3 h | Observed | 2 | 1.22 |
| Example 2 | 9:1 | 2.8-3.7 | −325 Mesh | 1250° C.-3 h | Observed | 2 | 1.20 |
| Example 3 | 5:1 | 2.8-3.7 | −325 Mesh | 1250° C.-3 h | Observed | 2 | 1.20 |
| Example 4 | 3:1 | 2.8-3.7 | −325 Mesh | 1250° C.-3 h | Observed | 2 | 1.15 |
| Example 5 | 1:1 | 2.8-3.7 | −325 Mesh | 1250° C.-3 h | Observed | 2 | 1.15 |
| Example 6 | 1:3 | 2.8-3.7 | −325 Mesh | 1250° C.-3 h | Partially Observed | 2 | 1.13 |
| Example 7 | 1:4 | 2.8-3.7 | −325 Mesh | 1250° C.-3 h | Partially Observed | 2 | 1.13 |
| Example 8 | 1:4 | ≥4.0 | −325 Mesh | 1250° C.-3 h | Partially Observed | 2 | 1.17 |
| Reference Example 1 | 7:1 | 2.8-3.7 | −325 Mesh | 1200° C.-0.5 h | Not Observed | 2 | 1.02 |
| Reference Example 2 | 7:1 | 2.8-3.7 | −325 Mesh | 1200° C.-3 h | Not Observed | 2 | 1.04 |
| Comparative Example 1 | 7:1 | 2.8-3.7 | −180 Mesh | — | Not Observed | 2 | 1.04 |

TABLE 1-continued

| | Mixing Ratio Mo:Cr | Particle Diameter of Mo (μm) | Particle Diameter of Cr | Sintering Condition | Disappearance of Peak | Pressure applied in Press Molding (t/cm$^2$) | Withstand Voltage (Relative Value) |
|---|---|---|---|---|---|---|---|
| Comparative Example 2 | 7:1 | 2.8-3.7 | −325 Mesh | — | Not Observed | 2 | 1.00 |

Table 1 shows the withstand voltage capabilities of the electrode materials of Examples 1-8, Reference Examples 1 and 2 and Comparative Examples 1 and 2. It is apparent from Examples 1-8 of Table 1 that the electrode materials of Examples 1-8 are electrode materials excellent in withstand voltage capability. Additionally, it can also be found that the withstand voltage capability of the electrode material gets more enhanced with an increase of the ratio of the heat resistant element contained in the electrode material. Namely, an electrode material according to an embodiment of the present invention undergoes: a mixing step for mixing a Cr powder and a heat resistant element powder; a provisional sintering step for provisionally sintering the mixed powder of the heat resistant element powder and the Cr powder; a pulverizing step for pulverizing the provisional sintered body; a main sintering step for sintering a powder obtained by pulverizing the provisional sintered body; and a Cu infiltration step for infiltrating the sintered body (skeleton) obtained by the main sintering step with Cu. With this, the particles where a heat resistant element and Cr are dissolved and diffused into each other are refined and uniformly dispersed, and accordingly it becomes possible to control the electrode material so as to have a composition where even Cu structures are refined and uniformly dispersed.

In an electrode material according to an embodiment of the present invention the fine particles (or the solid solution particles of a heat resistant element and Cr) where the heat resistant element and Cr are dissolved and diffused into each other can uniformly be dispersed, and therefore it is possible to decrease the current-interrupting capability and the contact resistance. The average particle diameter of the fine particles is to vary according to the average particle diameter of the raw material powders (i.e., the average particle diameter of the Mo powder and that of the Cr powder); however, it is possible to improve the current-interrupting capability of the electrode material and to reduce the contact resistance if the composition is so controlled that the average particle diameter of the fine particles obtained from the Fullman's equations is not larger than 20 μm, more preferably not larger than 15 μm.

Furthermore, by comparing the particle diameter of the Mo—Cr powder measured after provisional sintering and pulverization of the Mo—Cr powder with the average particle diameter of the Mo—Cr powder measured according to the Fullman's equations after the Cu infiltration step, it is found that the refinement of the Mo—Cr particles is further developed during the Cu infiltration step. More specifically, d50 of the Mo—Cr powder after pulverization was 30 μm while the average particle diameter of the Mo—Cr powder of the electrode material obtained from the Fullman's equations after the Cu infiltration step was not larger than 10 μm. From this fact, it is possible to produce an electrode material excellent in withstand voltage capability and current-interrupting capability by employing a Mo—Cr powder wherein the volume-based relative particle amount of particles having a particle diameter of 30 μm or less is 50% or more. Since the solid solution particles of a heat resistant element and Cr can be further refined through the Cu infiltration step it is possible to produce an electrode material excellent in withstand voltage capability and current-interrupting capability even in Examples 6-8 (the cases where a peak corresponding to Cr element is slightly observed in XRD measurement made on the solid solution powder of a heat resistant element and Cr).

Moreover, the electrode material according to an embodiment of the present invention is enhanced in electrical characteristics such as withstand voltage capability and current-interrupting capability because the fine particles where a heat resistant metal and Cr is dissolved and diffused into each other are uniformly distributed in Cu. An index of the dispersion state CV determined from an average value of a distance between barycenters of the fine particles and a standard deviation is not higher than 2.0, preferably not higher than 1.0, with which it is possible to obtain an electrode material excellent in withstand voltage capability and current-interrupting capability.

Additionally, it is possible to obtain an electrode material excellent in withstand voltage capability and current-interrupting capability by increasing the content of a heat resistant element in the electrode material. By increasing the content of a heat resistant element in the electrode material more and more, the withstand voltage capability of the electrode material tends to be enhanced. A case of the electrode material containing a heat resistant element only (or a case where the electrode material does not contain Cr), however, sometimes makes the Cu infiltration difficult. Therefore, in the solid solution powder a ratio of Cr element to the heat resistant element is preferably 4 or less to 1, more preferably ⅓ or less to 1 by weight, thereby making it possible to provide an electrode material excellent in withstand voltage capability.

In addition, the average particle diameter of a heat resistant element (such as Mo) may serve as a factor for determining the particle diameter of the solid solution powder of the heat resistant element and Cr. In other words, since Cr particles are refined by heat resistant element particles and then diffused into the heat resistant element particles by its diffusion mechanism to form a solid solution structure of the heat resistant element and Cr, the particle diameter of the heat resistant element is increased by a provisional sintering. The degree of increase due to provisional sintering depends on the mixed ratio of Cr. Hence the heat resistant element is provided to have an average particle diameter of 2-20 μm, more preferably 2-10 μm; with this, it is possible to obtain a solid solution powder of a heat resistant element and Cr which powder allows manufacturing an electrode material excellent in withstand voltage capability and current-interrupting capability.

In an electrode material according to an embodiment of the present invention, the electrode material is produced by the infiltration method. Therefore the electrode material has a charging rate of 95% or more so that the damages that the contact surface is to receive by arcs generated at current-interrupting time or current-starting time are lessened. Namely, this electrode material is excellent in withstand voltage capability because on the surface of the electrode material there is no fine unevenness caused by the presence of airspaces. This electrode material is excellent in mechanical strength since airspaces of a porous material are charged with Cu, and additionally excellent in withstand voltage capability since the hardness is greater than that of an electrode material produced by a sintering method.

If an electrode material according to an embodiment of the present invention is disposed at least at one of a fixed electrode and a movable electrode of a vacuum interrupter (VI), the withstand voltage capability of an electrode contact of the vacuum interrupter is to be improved. When the withstand voltage capability of the electrode contact is improved, a gap defined between the fixed electrode and the movable electrode can be shortened as compared with that of conventional vacuum interrupters and additionally a gap defined between the fixed electrode or the movable electrode and a main shield can also be shortened; therefore, it is possible to minify the structure of the vacuum interrupter. As a result, the vacuum interrupter may be reduced in size. Since the size of the vacuum interrupter can thus be reduced, it is possible to reduce the manufacturing cost of the vacuum interrupter.

Although an embodiment of the present invention has been described above by reference only to some specified preferable examples, the present invention is not limited to those. Various modifications and variations in the scope of the technical idea of the present invention will occur to those skilled in the art, and such variations and modifications are within the scope of the claims as a matter of course.

For example, though in the explanations having made on an embodiment of the present invention the provisional sintering temperature is set to 1250° C. (three hours), the provisional sintering temperature of the present invention is not lower than 1250° C. and not higher than the melting point of Cr, more preferably within a range of from 1250 to 1500° C. With this, the mutual dispersion of Mo and Cr is sufficiently developed, the subsequent pulverization of the Mo—Cr solid solution using a pulverizing machine is relatively easily performed and an electrode material is provided with great withstand voltage capability and current-interrupting capability. Moreover, the provisional sintering time may be changed according to the provisional sintering temperature; for example, a provisional sintering at 1250° C. is carried out for three hours but a provisional sintering at 1500° C. requires only a 0.5 hour of provisional sintering time.

Additionally, the Mo—Cr solid solution powder is not limited to the one produced according to the manufacturing method as discussed in the embodiment of the present invention, and therefore a Mo—Cr solid solution powder produced by any conventional manufacturing method (such as a jet mill method and an atomization method) is also acceptable.

Although the above-mentioned molding step uses a press machine for molding, the molding of the electrode material may be achieved by a CIP treatment or a HIP treatment. Furthermore, if the HIP treatment is performed after main sintering and before Cu infiltration the charging rate of the Mo—Cr sintered body is further enhanced, and as a result, the electrode material is further improved in withstand voltage capability.

Moreover, the electrode material of the present invention is not limited to the one consisting only of a heat resistant element, Cr and Cu. The addition of an element for improving the characteristics of the electrode material is also acceptable. For example, the addition of Te can improve the welding resistance of the electrode material.

The electrode material of the present invention is not limited to the production method as discussed in the above Examples, so long as the fine particles (the solid solution particles of a heat resistant element and Cr) where a heat resistant element and Cr are dissolved and diffused into each other are uniformly dispersed and the average particle diameter obtained from the Fullman's equations is not larger than 20 μm (more preferably not larger than 15 μm) and an index of the dispersion state CV determined from an average value of a distance between barycenters of the fine particles and a standard deviation is not higher than 2.0 (more preferably not higher than 1.0). For example, it may be manufactured by a dissolving method in which Cr and Cr or the like are dissolved at a certain composition ratio.

The invention claimed is:

1. A method for producing an electrode material, comprising:

a step of preparing a powder of a solid solution of Cr and a heat resistant material selected from the group consisting of Mo, W, Ta, Nb, V and Zr, wherein either a peak corresponding to Cr element or a peak corresponding to the heat resistant element, which are observed by X ray diffraction measurement made on the powder of the solid solution, disappears;

a step of molding the powder of the solid solution to obtain a molded body and then sintering the molded body to produce a sintered body; and a Cu infiltration step of infiltrating the sintered body with Cu.

2. A method for producing an electrode material, as claimed in claim 1, wherein in the powder of the solid solution the volume-based relative particle amount of particles having a particle diameter of 30 μm or less is 50% or more.

3. A method for producing an electrode material, as claimed in claim 1, wherein the powder of the solid solution has a ratio of Cr to the heat resistant element of 4 or less to 1 by weight.

* * * * *